US006119312A

United States Patent [19]

Leifeld

[11] Patent Number: 6,119,312

[45] Date of Patent: Sep. 19, 2000

[54] DEVICE MOUNTED ON A SPINNING PREPARATION MACHINE, SUCH AS CARDING MACHINE, A DRAW FRAME OR THE LIKE, FOR GUIDING AND COMPRESSING A SLIVER BUNDLE

[75] Inventor: Ferdinand Leifeld, Kempen, Germany

[73] Assignee: Trützschler GmbH & Co. KG, Mönchengladbach, Germany

[21] Appl. No.: 09/297,516

[22] PCT Filed: Apr. 22, 1998

[86] PCT No.: PCT/EP98/02386

§ 371 Date: May 3, 1999

§ 102(e) Date: May 3, 1999

[87] PCT Pub. No.: WO99/13141

PCT Pub. Date: Mar. 18, 1999

[30] Foreign Application Priority Data

Sep. 8, 1997 [DE] Germany ..... 197 39 189

[51] Int. Cl.[7] ..... D01B 3/04

[52] U.S. Cl. ..... 19/65 A; 19/150; 19/157; 57/412

[58] Field of Search ..... 19/65 A, 150, 19/157, 236, 239, 258, 237, 238, 240, 259, 260, 151, 152, 153; 57/412

[56] References Cited

U.S. PATENT DOCUMENTS

| | | | |
|---|---|---|---|
| 3,635,006 | 1/1972 | Fehrer | 19/153 |
| 4,630,336 | 12/1986 | Schopwinkel et al. | 19/150 |
| 5,461,757 | 10/1995 | Leifeld | 19/239 |
| 5,619,772 | 4/1997 | Leifeld | 19/240 |
| 5,630,251 | 5/1997 | Leifeld | 19/239 |
| 5,673,462 | 10/1997 | Leifeld | 19/239 |

FOREIGN PATENT DOCUMENTS

| | | |
|---|---|---|
| 0 412 256 | 2/1991 | European Pat. Off. . |
| 2073039 | 9/1971 | France . |
| 33 27 574 | 11/1984 | Germany . |
| 5-117920 | 5/1993 | Japan . |
| 1155598 | 6/1969 | United Kingdom . |

*Primary Examiner*—John J. Calvert
*Assistant Examiner*—Gary L. Welch
*Attorney, Agent, or Firm*—Venable; Gabor J. Kelemen

[57] ABSTRACT

A device for guiding and compressing a sliver running through the device in a travel direction includes first and second guide elements adjoining one another in the travel direction. Each guide element has two opposite first sides and two opposite second sides. Each guide element is formed of two face-to-face disposed wall elements which are spaced from one another perpendicularly to the travel direction and which form the first sides of the guide element. The second sides of each guide element are open in a direction perpendicular to the travel direction. The first and second guide elements are offset at an angle with respect to one another as related to the travel direction.

16 Claims, 3 Drawing Sheets

DEVICE MOUNTED ON A SPINNING PREPARATION MACHINE, SUCH AS CARDING MACHINE, A DRAW FRAME OR THE LIKE, FOR GUIDING AND COMPRESSING A SLIVER BUNDLE

BACKGROUND OF THE INVENTION

The invention relates to a device mounted on a spinning preparation machine, e.g. a carding machine, draw frame or the like, for guiding and compressing a sliver bundle consisting of at least one sliver. The device comprises at least two funnel-shaped guide elements, arranged one behind the other, which have a plurality of successively arranged wall surfaces along which the sliver bundle glides and is concentrated, wherein at least one wall area is provided between the input opening and the output opening in which the sliver bundle comes in contact with the outside air through an opening.

A known device mounted on a carding machine has two funnel-shaped guide elements, arranged successively between a web-guiding element and a web trumpet, wherein the one funnel-shaped guide element that is facing downward is opened completely in the wall region while the other funnel-shaped guide element that is facing upward is completely open in the wall region. The two guide elements are each formed by three wall elements, two of which are facing each other. Approximately at a right angle to this, the two opposite-arranged wall surfaces are connected respectively on one side with a third wall surface, whereas the other, opposite arranged side, is designed as a through opening, meaning the guide element is open toward one side. The two opposite arranged wall surfaces of the guide elements are —seen one behind the other —aligned parallel to each other. The wall surfaces of the web trumpet are closed on all sides. The problem with this device is that inside each guide element, the fiber material compression and the air escaping the fiber material as a result of the compression are not symmetrical. The compression and the escaping air are also not symmetrical in relation to the two guide elements.

SUMMARY OF THE INVENTION

It is therefore the object of the invention to create a device of the above-described type which avoids the aforementioned disadvantages and for which the compression of the fiber material and the air escaping the fiber material in particular are evened out.

This object and others to become apparent as the specification progresses, are accomplished by the invention, according to which, briefly stated, the device for guiding and compressing a sliver running through the device in a travel direction includes first and second guide elements adjoining one another in the travel direction. Each guide element has two opposite first sides and two opposite second sides. Each guide element is formed of two face-to-face disposed wall elements which are spaced from one another perpendicularly to the travel direction and which form the first sides of the guide element. The second sides of each guide element are open in a direction perpendicular to the travel direction. The first and second guide elements are offset at an angle with respect to one another as related to the travel direction.

The device consists of two and more guide elements, wherein according to the invention each separate guide element consists of only two opposite arranged wall elements, so that the fiber material is compressed in one direction only. Owing to the fact that each wall element is open toward both sides, equal amounts of air can escape toward both sides. The compression and the air escape are balanced in this way. On the one hand, the unchecked, lateral expansion of the fiber material toward the open sides is limited or prevented by the fact that respectively adjacent, successive wall elements are arranged at an angle, preferably a 90° angle, to each other. On the other hand, it is simultaneously possible for the compression air to escape unhindered through the openings on both sides of each individual guide element. Furthermore, the friction caused by the wall surfaces is reduced inside each guide element, and there is no friction at all on the side wall surfaces because of the side openings. With respect to one guide element, the compression occurs respectively only in one direction, e.g. in the lateral direction with a vertical arrangement of the wall elements and for the immediately adjacent guide element in vertical direction because of the horizontal arrangement of wall elements. It means that the compressing direction and the air escape direction alternate. As a result of the measures according to the invention, in particular based on the symmetry of the device, the compression and the air escape are advantageously combined.

The invention has the following additional advantageous features:

Two adjacent wall elements should preferably be at a distance to each other. It is advantageous if the wall elements have a circular cross section, and the wall elements preferably consist of a rod, a bar, a bolt or the like. It is useful if the wall elements are made of a wear-resistant material, e.g. hardened steel. The wall elements are preferably stationary during the operation and are advantageously driven so as to rotate when conveying the fiber material. It is preferable if the location of at least one wall element of a guide element can change location, e.g. through sliding, pivoting or the like. Expediently a guide element and a sliver trumpet are installed alternately, one after another. The fiber guide member is advantageously arranged at the output of a carding machine. The sliver guide member in the form of a sliver trumpet is preferably arranged at the output of a draw frame. Two withdrawing rolls are preferably arranged in sequence after the sliver guide member. Preferably at least one measuring element for measuring the thickness of the sliver bundle is assigned to the sliver guide member.

In the following, the invention is explained in further detail with the aid of drawings of exemplary embodiments.

Shown are in:

DESCRIPTION OF THE PREFERRED EMBODIMENTS

Figure 1:
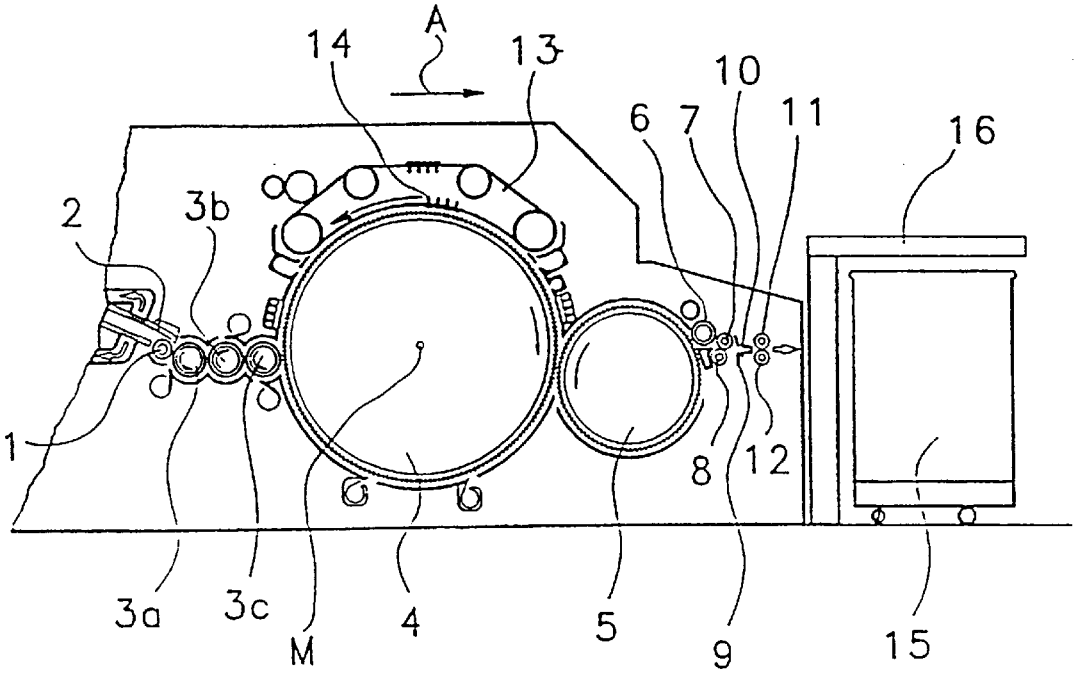
FIG. 1 is a schematic view from the side of a carding machine with the device according to the invention.

FIG. 1 shows a carding machine, e.g. a Trützschler EXACTACARD DK 803, with feed roll 1, feed table 2, licker-ins 3*a*, 3*b*, 3*c*, main carding cylinder 4, doffer 5, stripping roll 6, crushing rolls 7, 8, web guiding element 9, web trumpet 10, withdrawing rolls 11, 12, traveling flats assembly 13 with flat bars 14, coiler can 15 and coiler 16. Curved arrows indicate the rotational directions of the rolls. The schematically shown sliver trumpet 10 is embodied according to the invention.

Figure 2:
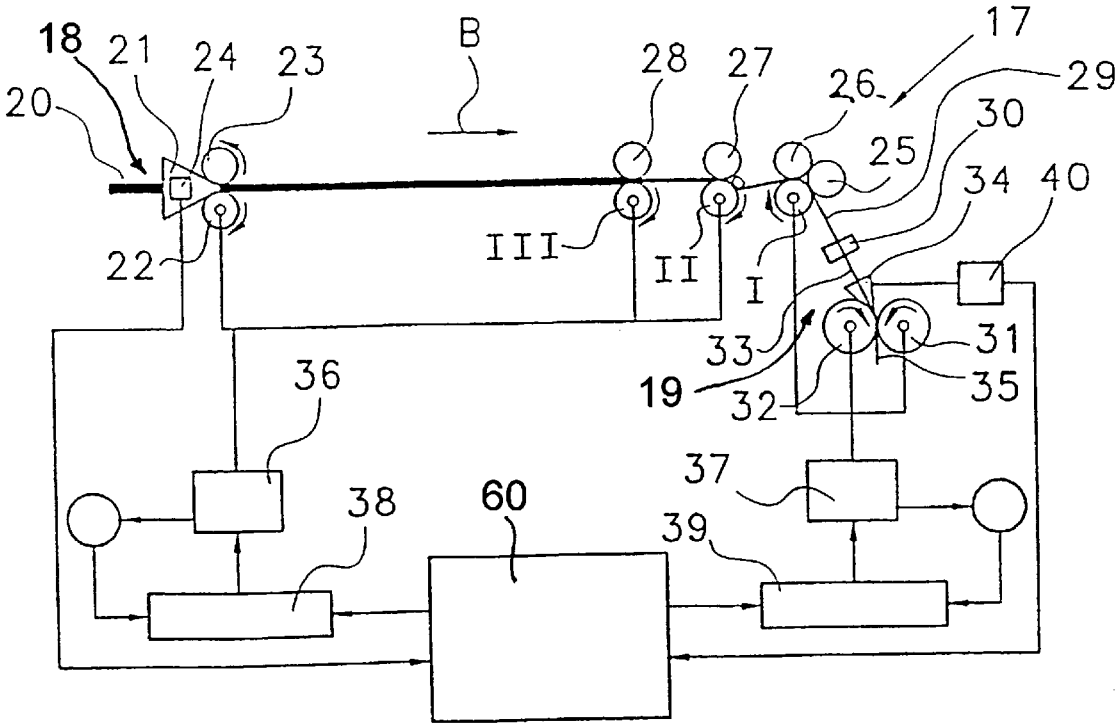
FIG. 2 is a schematic side view of a draw frame with the device according to the invention as sliver guide member and sliver measuring unit.

According to FIG. 2, a draw frame, e.g. a Trützschler draw frame HSR, comprises a drawing unit 17 with a drawing unit inlet 18 in front and a drawing unit outlet 19 behind it. The slivers 20 coming from the coiler cans enter the sliver guide 21 and are transported, pulled by the withdrawing rolls 22, 23, past the measuring unit 24. The drawing unit 17 is configured as a 4-over-3 drawing unit, meaning it consists of three lower rolls I, II, III (I lower roll at the output, II lower roll in the center, III lower roll at the input) and four upper rolls 25, 26, 27, 28. The drawing of the bundle of slivers 20, composed of a plurality of slivers, takes place in the drawing unit 17. The drawing consists of the pre-drawing and the main drawing. The roll pairs 28/III and 27/II form the pre-drawing zone and the roll pairs 27/II and 25, 26/I form the main drawing zone. The drawn slivers 29 reach a web guide 30 in the drawing unit intake and are pulled in the form of a bundle 35 and by means of the withdrawing rolls 31, 32 through a sliver trumpet 34, in which they are combined to form a sliver bundle 35 that is subsequently deposited in coiler cans.

The withdrawing rolls 31, 32, the lower roll III at the input and the lower roll II in the center, which are for example coupled mechanically with toothed belts, are driven by the variable speed motor 36, wherein a desired value can be preset. (The associated upper rolls 28 and 27 rotate along.) The main motor 37 drives the lower output roll I and the withdrawing rolls 31, 32. Separate controllers 38 and 39 are provided for the variable speed motor 36 and the main motor 37. The control (speed control) occurs respectively via a closed control circuit, wherein separate tachometer generators are assigned to the control unit 36 and the main motor 37. At the drawing unit intake, an area that is proportional to the mass, e.g. the cross section of the fed-in slivers 20, is measured by an intake measuring unit 24. At the drawing unit intake, the cross section of the exiting sliver bundle 35 is obtained with an output measuring unit 40 that is associated with the sliver trumpet 34. The sliver trumpet 34, shown schematically here, is embodied according to the invention.

A central computer unit (60) (control and regulating equipment), for example a microcomputer with microprocessor, transmits a setting for a desired value for the variable speed motor 36 to the controller 38. The measured values from the two measuring units 24 and 40 are transmitted during the drawing process to the central computer unit 41. The desired value for the variable speed motor 36 is determined in the central computer unit 41 from the values measured at the intake measuring unit 24 and the desired value for the cross section of the exiting sliver bundle 35. The values measured at the output measuring unit 40 are used for monitoring the exiting sliver bundle 35 (sliver output monitoring). With the aid of this automatic control system, it is possible to compensate fluctuations in the cross section of the fed-in slivers 20 through corresponding adjustments in the drawing process, or it is possible to make the sliver bundle 35 more uniform.

Figure 3:
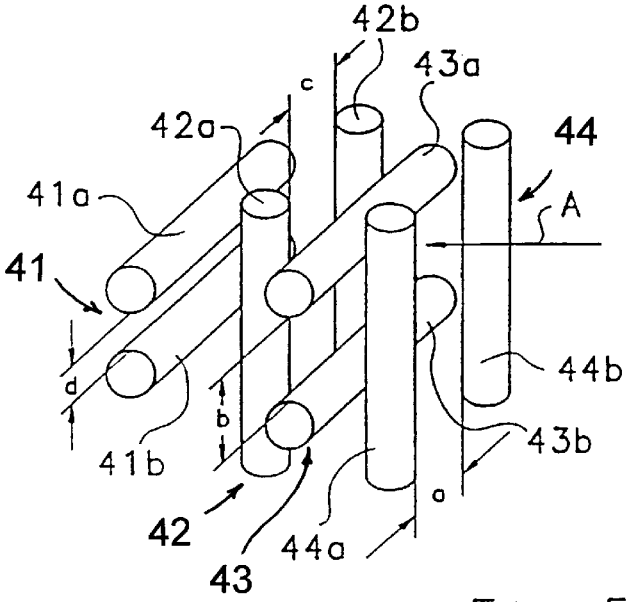
FIG. 3 is an exploded view of the device according to the invention with round bars as wall elements.

According to FIG. 3, the sliver guide member is composed of four guide elements 41 to 44, which are respectively formed by two wall elements 41*a*, 41*b* to 44*a*, 44*b*, arranged on opposite sides. The wall elements 41*a* to 44*b* consist of rod-shaped material, e.g. of hardened steel with a circular cross section. The opposite arranged wall elements of each guide element 41 to 44 are arranged parallel to each other, with a distance a, b, c and d between the wall elements 44*a*, 44*b*, 43*a*, 42*a*, 42*b* or 41*a*, 41*b* . These distances decrease in operating direction A, meaning in the movement direction of the sliver material. Owing to the distance, e.g. distance a between the wall elements 41*a*, 41*b*, each guide element 41 to 44 is open toward both sides. Guide elements 41 to 44, respectively arranged one behind the other, are positioned at an angle of 90° to each other with respect to the longitudinal axis of the device, which essentially coincides with the operating direction A.

Figure 4:
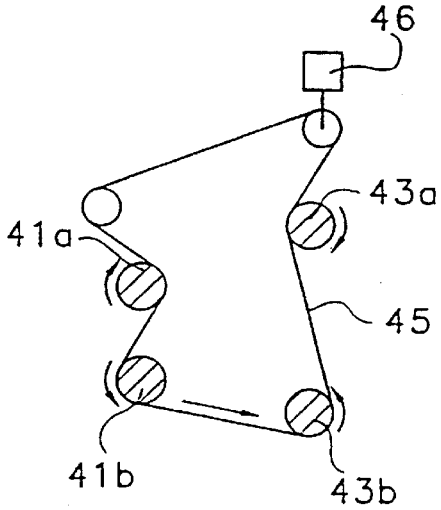
FIG. 4 is an arrangement of round bars according to FIG. 3, driven so as to rotate.

According to FIG. 4, the wall elements 41*a*, 41*b*, 43*a*, 43*b* are positioned such that they can rotate and are driven by an endlessly circulating drive element, e.g. the belt 45, via a drive unit such as the motor 46. The curved arrows indicate the rotational direction. The wall elements 42*a*, 42*b*, 44*a*, 44*b* are also positioned such that they can rotate and can be driven in a like manner (not shown here).

Figure 5A:
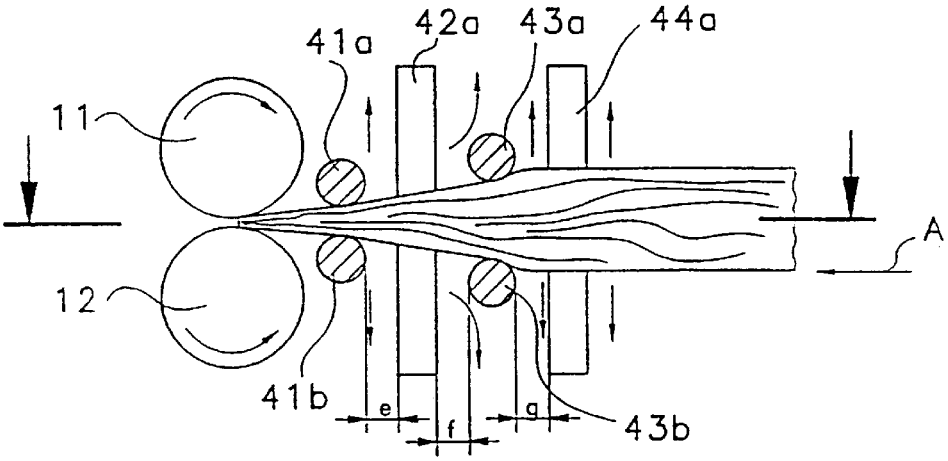
FIGS. 5*a*, 5*b* is a view from the side and a view from the top along section I —I of the device according to the invention, respectively with a distance between adjacent guide elements.
Figure 5B:
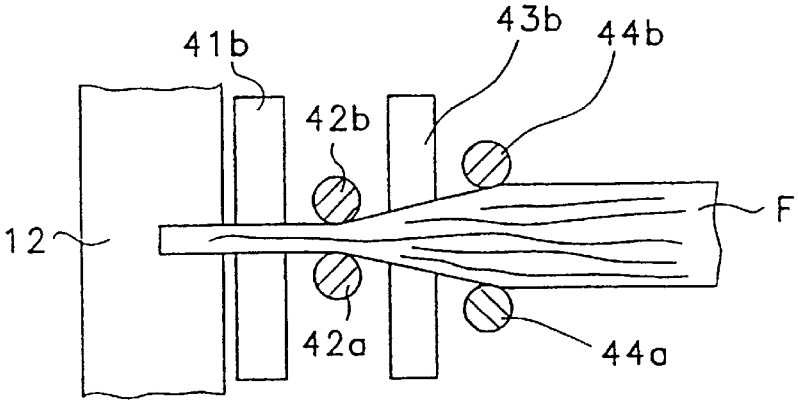
Figure 6:
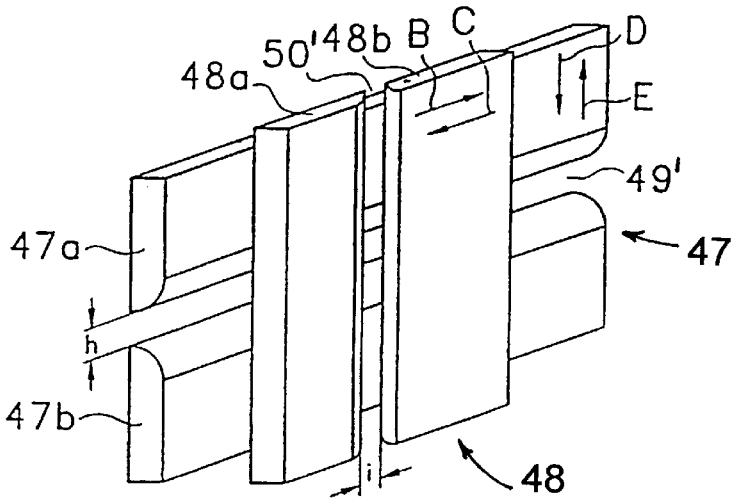
FIG. 6 is an exploded view of an embodiment with profile members as wall elements.

According to FIGS. 5*a*, 5*b*, a pair of driven withdrawing rolls 11, 12 is installed downstream of the output for the sliver guide member, which rolls can be turned in the direction of the curved arrows. A distance e, f or g is respectively provided between two adjacent guide elements 41 to 44. The air leaving the sliver bundle in the direction of the arrows during the compressing can escape in this way. The fiber material is given the reference F. According to FIG. 6, the sliver guide member consists of two guide elements 47, 48 that are respectively formed by two opposite arranged wall elements 47*a*, 47*b* and 48*a*, 48*b*. The wall elements 47*a*, 47*b* and 48*a*, 48*b* are designed as profile pieces. The wall element 48*b* can be moved (in a manner not shown) in the direction of the arrows B, C and wall element 47*a* can be moved (in a manner not shown) in the direction of the arrows D, E. The gaps 49 and 50 between the wall elements are changed in this way, thereby making it possible or making it easier to start the spinning process (inserting of new slivers F).

Figure 7:
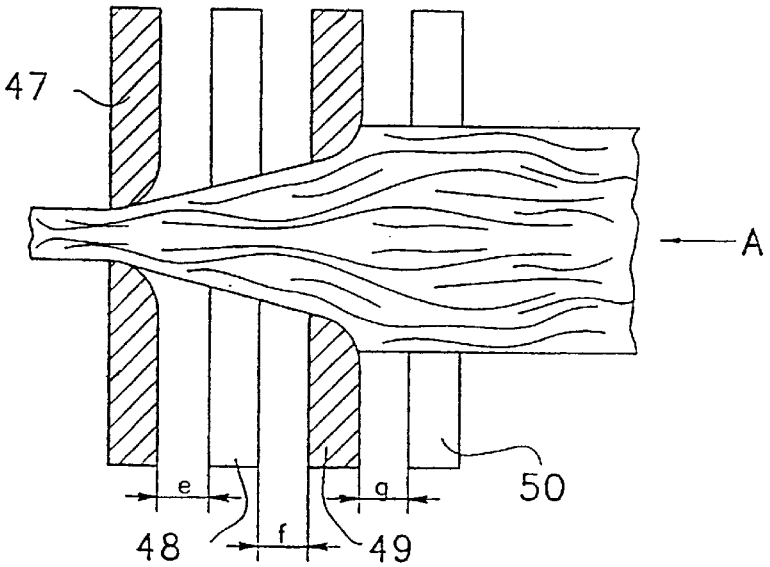
FIG. 7 is a view from the side along the section II —II through the embodiment according to FIG. 6, but with four guide elements.

FIG. 7 shows how the cross section of the sliver bundle F decreases in operating direction A and how the sliver bundle F is compressed in the process. The air escapes through the side openings between two parallel wall elements 47*a* to 50*b* as well as through the intermediate spaces e, f and g between successively arranged guide elements. The fiber material is compressed between the two wall elements of the respective guide elements 47 through 50 only in one direction, e.g. in vertical direction or horizontal direction. The friction is reduced owing to the fact that with a guide element 47 to 50, the fiber material respectively glides only along the two surfaces of the respective opposite arranged wall elements of the guide elements 47 to 50 and that no gliding surface exists on the side because of the opening. As a result of adjacent guide elements 47 to 50 being turned relative to each other by 90°, the sliver bundle—provided the guide element has openings toward the sides—still cannot escape because of the wall elements of the preceding and the following guide element and is thus guided. This type of design is suitable for strong compression with a high amount of escaping air.

Figure 8:
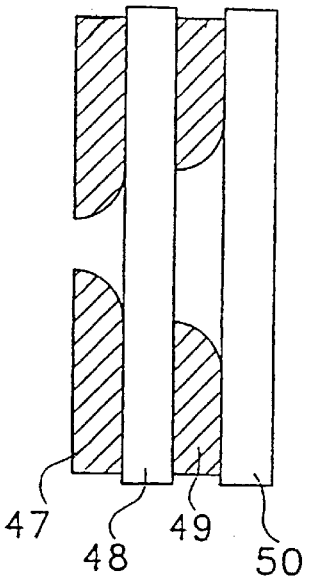
FIG. 8 is an embodiment without spacing between adjacent guide elements.

According to FIG. 8, no spaces exist between the guide elements 47 to 50 in operating direction. This embodiment can be used for a compression where only small amounts of air escape.

Figure 9:
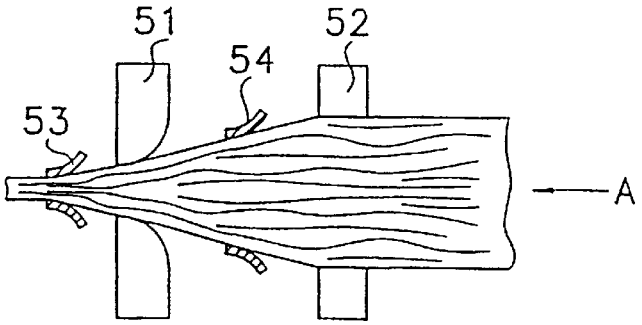
FIG. 9 is a view from the side of a section through an embodiment with guide element and sliver trumpet arranged alternately, one behind the other.

According to FIG. 9,two guide elements 51 and 52 and two sliver material trumpets 53 and 54 are arranged alternately, one after the other.

What is claimed is:

1. A device for guiding and compressing a sliver running in a travel direction through the device in a spinning preparation machine; said device comprising first and second guide elements adjoining one another in said travel direction for guiding and gathering the running sliver; each said guide element having two opposite first sides and two opposite second sides; each said guide element being formed of two facing wall elements spaced from one another perpendicularly to said travel direction; said wall elements constituting said first sides; each said second side of each said guide element being at least partially open in a direction perpendicular to said travel direction; said first and second guide elements being offset at an angle with respect to one another as related to said travel direction.

2. The device as defined in claim 1, wherein said angle is 90°.

3. The device as defined in claim 1, wherein said first and second guide elements are spaced from one another.

4. The device as defined in claim 1, wherein said wall elements have a circular cross section.

5. The device as defined in claim 1, wherein each said wall element of at least one of said guide elements is a bar.

6. The device as defined in claim 1, wherein each said wall element of at least one of said guide elements is a bar of circular cross section.

7. The device as defined in claim 1, wherein said wall elements are of a wear resistant material.

8. The device as defined in claim 1, wherein said wall elements are of hardened steel.

9. The device as defined in claim 1, wherein said wall elements are stationary during operation.

10. The device as defined in claim 1, further comprising drive means for rotating said wall elements to convey the sliver.

11. The device as defined in claim 1, wherein at least one of said two wall elements of one of said guide element is movable relative to the other of said two wall elements for varying a width of said second, open sides of said one guide element.

12. The device as defined in claim 1, further comprising a sliver trumpet positioned between said first and second guide elements.

13. The device as defined in claim 1, wherein the wall elements of at least one of said guide elements are oriented parallel to one another.

14. The device as defined in claim 1, wherein said first guide element is located upstream of said second guide element as viewed in said travel direction; and further wherein said wall elements of said first guide element are spaced from another at a greater distance than said wall elements of said second guide element.

15. The device as defined in claim 1, in combination with a carding machine having an inlet; said device being positioned at said inlet and constituting a sliver trumpet.

16. The device as defined in claim 1, in combination with a draw frame having an inlet; said device being positioned at said inlet and constituting a sliver trumpet.

* * * * *